United States Patent [19]

Meno

[11] 4,429,607

[45] Feb. 7, 1984

[54] LIGHT BEAM MUSICAL INSTRUMENT

[75] Inventor: Frank Meno, Pittsburgh, Pa.

[73] Assignee: University of Pittsburgh, Pittsburgh, Pa.

[21] Appl. No.: 363,411

[22] Filed: Mar. 30, 1982

[51] Int. Cl.[3] ..... G10H 1/34; G10H 1/46

[52] U.S. Cl. ..... 84/1.18; 84/1.24; 84/1.27; 84/DIG. 7; 340/365 P

[58] Field of Search ..... 84/1.18, 1.24, 1.25, 84/1.27, 1.09, 1.1, DIG. 7, DIG. 8, DIG. 19; 340/365 P

[56] References Cited

U.S. PATENT DOCUMENTS

| | | | |
|---|---|---|---|
| 2,941,434 | 6/1960 | Clark | 84/1.18 |
| 3,038,363 | 6/1962 | Miessner | 84/1.14 |
| 3,214,507 | 10/1965 | Williams | 84/1.18 |
| 3,405,222 | 10/1968 | Heinzl | 84/1.18 |
| 3,526,775 | 9/1970 | Friedrich et al. | 340/365 P X |
| 3,562,399 | 2/1971 | Yamauchi et al. | 84/1.25 |
| 3,621,268 | 11/1971 | Friedrich et al. | 340/365 P X |
| 3,647,927 | 3/1972 | Chang et al. | 84/1.18 |
| 3,733,953 | 5/1973 | Ferber | 84/1.16 |
| 3,751,573 | 8/1973 | Bartok et al. | 84/1.18 |
| 3,800,059 | 3/1974 | Pavia | 84/1.24 |
| 3,911,776 | 10/1975 | Beigel | 84/1.24 X |
| 3,919,911 | 11/1975 | Nakata et al. | 84/1.27 |
| 3,986,426 | 10/1976 | Faulhaber | 84/1.25 X |
| 4,028,977 | 6/1977 | Ryeczek | 84/1.16 |
| 4,106,384 | 8/1978 | Whittington et al. | 84/1.25 X |

*Primary Examiner*—S. J. Witkowski

*Attorney, Agent, or Firm*—Buell, Blenko, Ziesenheim & Beck

[57] ABSTRACT

A musical instrument is disclosed in which light beams striking a detector produce various tones and the loudness of the sounds produced is dependent upon the intensity of the light beam which can be changed by interrupting the beam or reflecting the light backwards to a detector situated next to the light source. A special amplifier circuit is provided which responds to both the amount of light beam interruption as well as the rapidity of interruption. The invention can be variously embodied in woodwind, string and percussion instruments and can also be used on a stage and controlled by moving dancers or musicians.

13 Claims, 8 Drawing Figures

LIGHT BEAM MUSICAL INSTRUMENT

FIELD OF INVENTION

The invention relates to musical instruments in which light beams striking detectors produce various tones.

Description of the Prior Art

In the past light beams have been used to produce musical sounds. Typically, the light shines on a series of photocells connected to an amplifier and speaker. When light strikes the cell a tone is produced or stopped. Most prior art light beam musical instruments utilize a shutter to control the light beam. However, Meissner in U.S. Pat. No. 3,038,363 interrupts the light beam with a metal reed and Ferber in U.S. Pat. No. 3,733,953 uses vibrating guitar strings. Yet, in all prior art light beam musical instruments interruption of the light beam stops or creates a sound. Volume is not controlled by the light beam.

In the present invention the loudness of sounds produced is dependent upon the intensity of the light beam which can be changed by interrupting the beam or reflecting the light backwards to a detector situated next to the light source. To make the instrument respond to variations in light intensity I provide a special amplifier circuit which responds to both the amount of the light beam interruption as well as the rapidity of interruption.

The present invention can be variously embodied for use in string, woodwind and percussion instruments. In addition, the invention can be embodied so that movement of dancers on a stage will control the loudness of the musical sounds.

Other details, objects and advantages of the invention will become apparent from the following description of the drawings.

DESCRIPTION OF THE PREFERRED EMBODIMENTS

Figure 1:
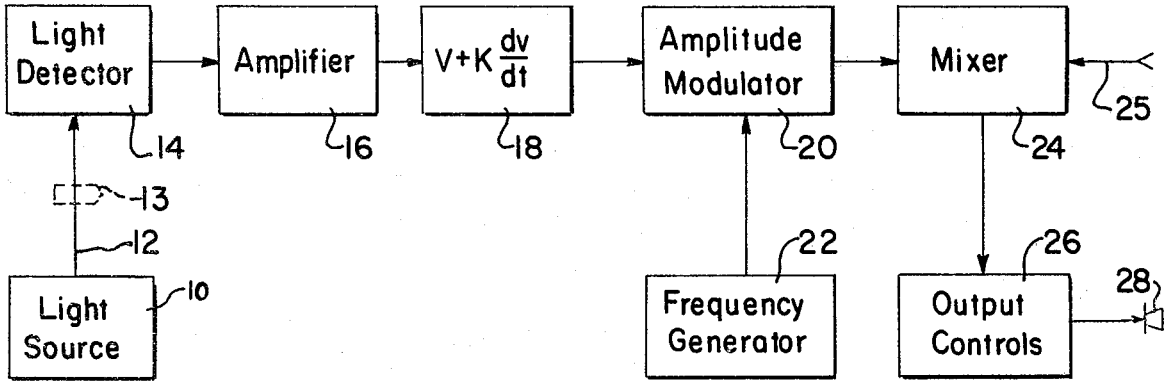
FIG. 1 is a block diagram of the invention.
Figure 2:
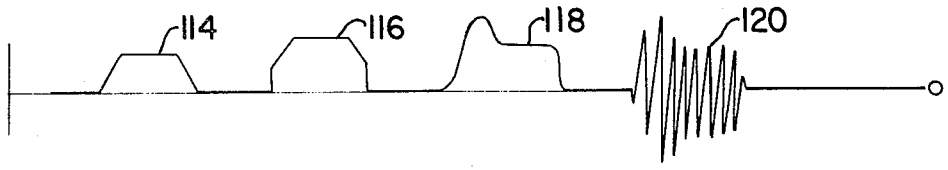
FIG. 2 is a graph showing how the signal from the light detector is modified by the invention.

Referring to FIGS. 1 and 2 a light source 10 is provided which emits a light beam 12 toward detector 14. When light strikes the detector it emits a signal, shown as wave 114 in FIG. 2, which is amplified by amplifier 16 into signal 116. If the light beam is blocked at interrupter 13 (shown in chain line) no signal will be emitted from the detector 14. The interrupter 13 could be an instrument key, a string, a finger or a body. After the signal is amplified it goes to a special amplifier 18 which responds to the amount of light beam interruption (indicated by the signal coming from detector 14) and the rapidity of the interruption. A signal 5 (indicated as "V" in FIG. 1) entering this amplifier would be transformed into $S+K\ ds/dt$ where K is a constant and $dS/dt$ is the first derivative of S with respect to time. The transformed signal is shown as wave 118 in FIG. 2. Thus modified, the signal is applied to a voltage controlled amplitude modulator 20 to control the amplitude (and hence the loudness) of the signal which is supplied by a frequency generator 22. The signal emitted by the amplitude modulator 20, shown as wave 120 in FIG. 2, may be fed to a mixer 24 and there combined with other signals 25. The mixer 24 can be attached to output controls 26 which may filter, color or amplify the output before it is fed to a speaker 28.

Figure 3:
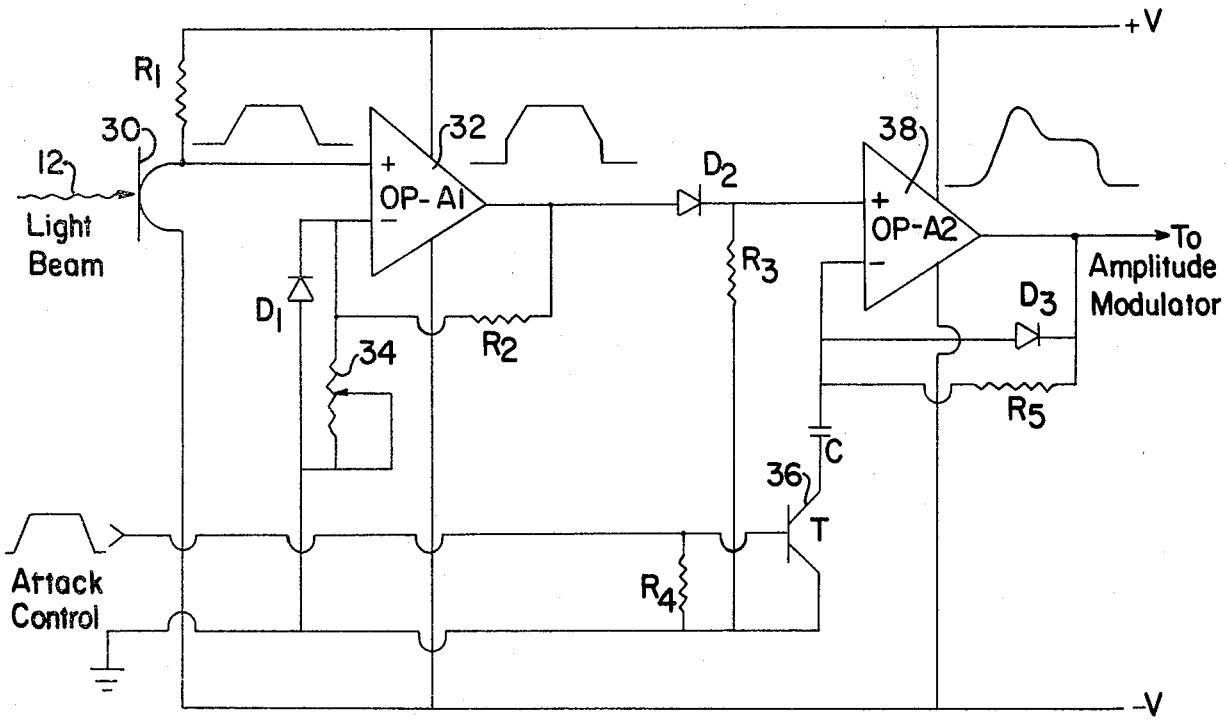
FIG. 3 is a circuit diagram of the present preferred circuit for the detector and light sensitive amplifier of FIG. 1.

The present preferred circuitry for the light detector 14, amplifier 16 and special amplifier 18 is shown in FIG. 3. As shown in FIG. 3, a light beam 12 strikes a photo transistor 30. The operational amplifier 32 is driven at the output below ground level when the light beam is not interrupted. As the light beam begins to be interrupted the photo transistor supplies a positive signal which is greatly amplified due to the by-pass diode $D_1$. When the signal crosses the ground level, $D_1$ becomes reverse biased, and the amplification depends upon the setting of the variable resistor 34. The emerging output signal is coupled through diode $D_2$ so that only a positive ground-referenced portion is transmitted to the next stage. This second stage controls the rapidity of attack by differentiating the input signal S to output signal $S_o$ according to the formula: $S_o=S[1+(sRC)/(1+sTC)]$ where T represents the effective resistance of the control transistor 36, C is the capacitance of C, R is the resistance of $R_5$, and $s=j\omega=j2\pi f$. Thus, if the transistor is kept non-conducting, T is very large and the transfer function is merely unity, the output signal emerges unaffected. However, if the transistor is brought into conduction through supplying a positive signal controlled by a foot pedal, then T becomes small and the output signal has a large differentiated component. The diode $D_3$ cuts out the negative part of the derivative. The signal from operational amplifier 38 is then applied to a voltage controlled amplitude modulator (see FIG. 1) to control the volume of a tone supplied by a frequency generator as described above.

Figure 4:
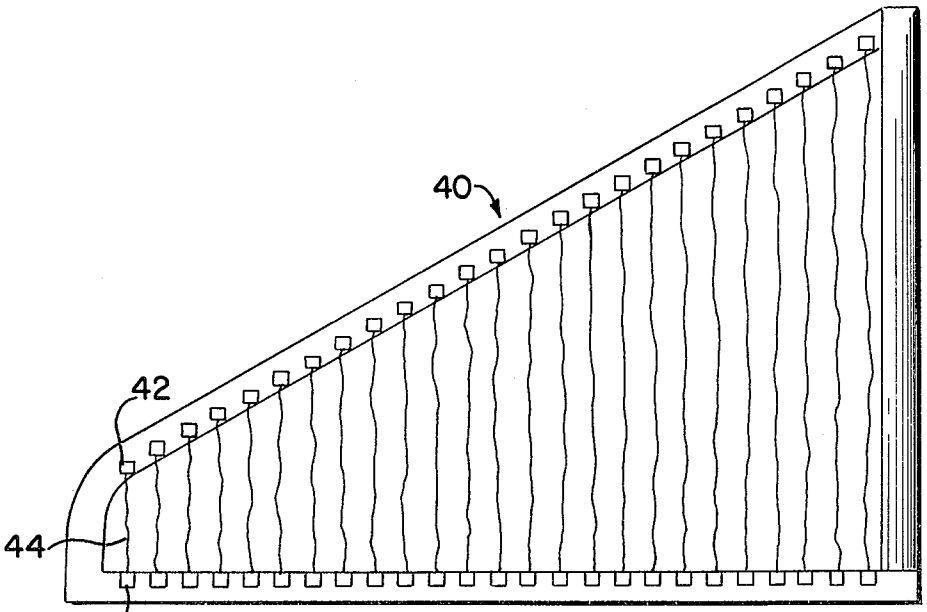
FIG. 4 is a side elevational view of a harp to which a present preferred embodiment of the invention is attached.

In FIG. 4 the invention is applied to produce a harp-like instrument using light sources 41 and detectors 42. Each light source produces a beam of light 44 which can be interrupted with fingers. The light beams can be made of different colors in the spectrum to correspond to different notes. Each light detector is wired to an amplifier, special amplifier, amplitude modulator and frequency generator as shown in FIG. 1. The signals from all of the amplitude modulators can be mixed electronically and directed to a single output. In this instrument I prefer to use light beams in place of the strings of a harp because it would be expensive to produce a instrument containing strings and light source—light detector pairs associated with each string. However, one could use my invention in this manner. Alternatively, one could make a harp-like instrument containing various combinations of light source—light detector pairs and strings. For example, strings could be placed at octave intervals for a chosen note to indicate where the octave changes.

Figure 5:
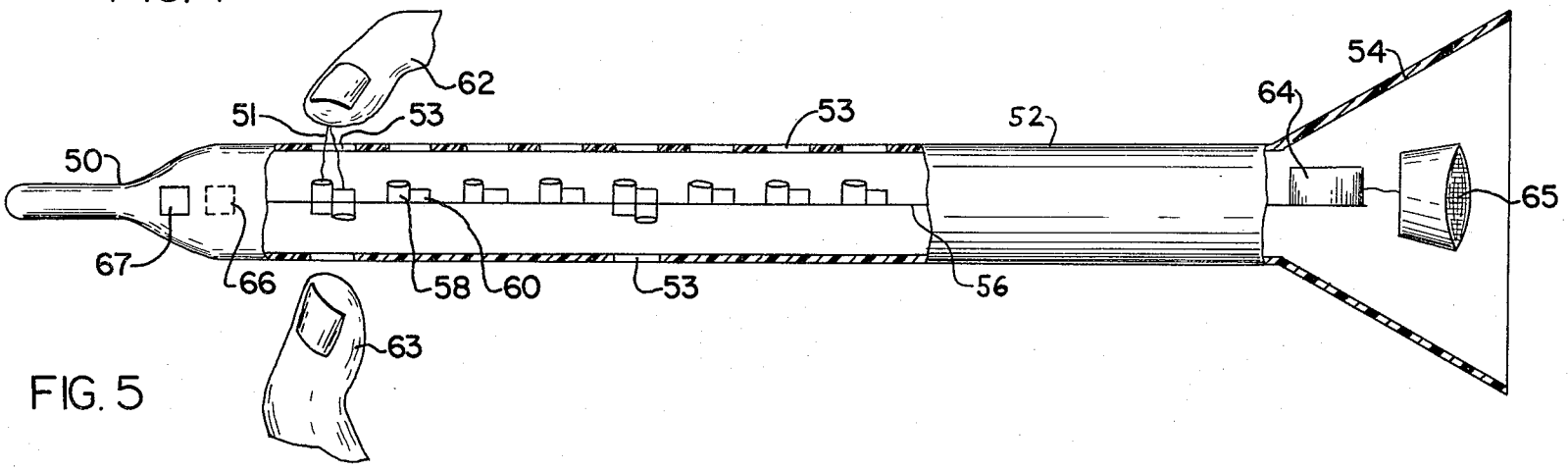
FIG. 5 is a side view partially in section of a wind instrument employing a second preferred embodiment of the invention.

A woodwind-like instrument employing another embodiment of the invention is shown in FIG. 5. The instrument has a mouthpiece 50, body 52 and bell 54. A plurality of keyholes 53 are provided along the body. A rib 56 runs through the center of the body and serves as a mounting for light sources 58 and detectors 60. One light source 58 and one detector 60 is provided for each keyhole 58. When a finger 62, thumb 63 or instrument key (not shown) is positioned over a keyhole light 51 from the light source will be reflected back to the detector 58 which is wired as illustrated in FIG. 1. The reflected light will cause a signal to flow to the amplification, mixing and filtering circuits 64 and speaker 65 contained in the bell 54 to produce sounds. A pressure transducer 66 that senses air pressure and attached sponge pad 67 for filtering noise are provided in the mouthpiece for overall volume control. Another embodiment for volume control can be implemented by pressing a transducer with the lips or teeth to change the signal flowing from the transducer 66 to the amplification, mixing and filtering circuits 64 thereby changing the volume. To eliminate the need for providing amplifiers and a speaker inside the instrument an output jack can be provided to connect the instrument to external amplifiers and speakers. This would enable the instrument to be connected to high quality external sound systems or recording devices.

Figure 6:
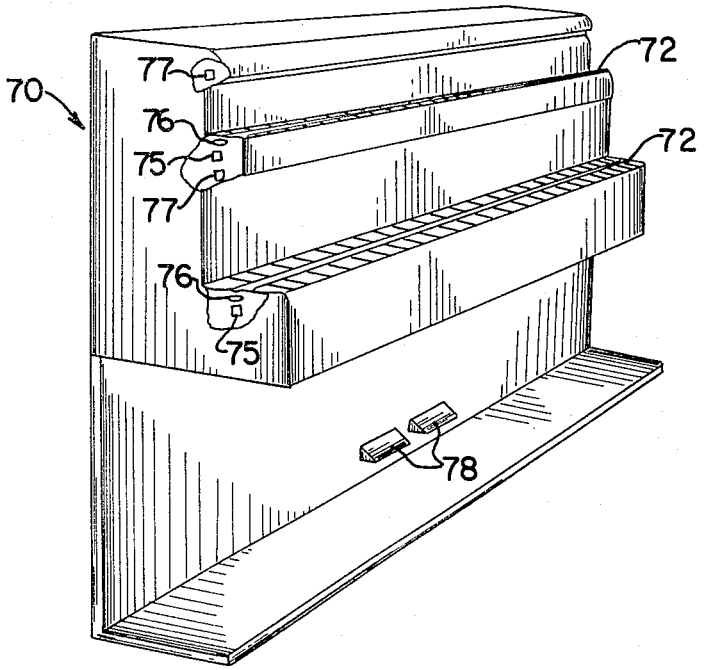
FIG. 6 is a perspective view partially in section of a keyboard instrument employing a third preferred embodiment of the invention.
Figure 7:
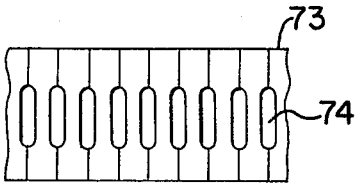
FIG. 7 is a top plan view of a portion of the keyboard for the keyboard instrument of FIG. 6.

Referring now to FIGS. 6 and 7, a keyboard instrument is shown having a body 70 containing two keyboards 72. Each keyboard is comprised of a rectangular plate 73 having a series of slots 74 in it. A light source 75 and optional lens 76 are positioned below each slot to direct light through the slot and focus it on a detector. A light detector 77 is positioned above each slot. The light detectors are wired to amplification, mixing and filtering circuits in a manner such that interruption of a given light source—light detector combination will produce a unique sound. Pedals 78 are provided for controlling overall loudness and to control the attack on transistor T in FIG. 3.

Figure 8:
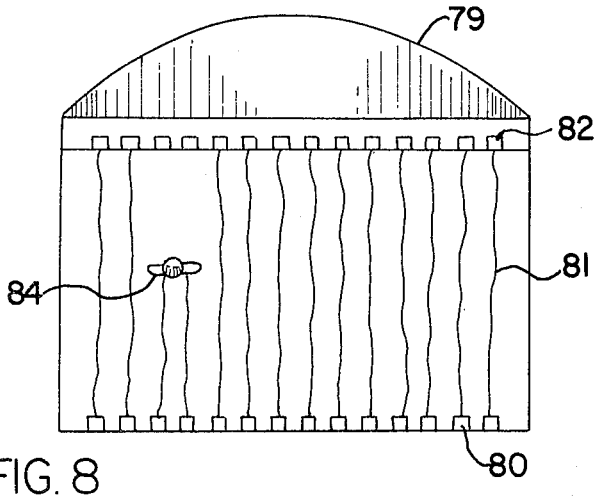
FIG. 8 is a top plan view of a fourth preferred embodiment of the invention which is activated by dancers moving across a stage.

A final preferred embodiment shown in FIG. 8 is comprised of light sources 80 and light detectors 82 positioned on a stage 79. The light detectors are connected to other components as discussed above so that sounds will be produced by light beams 81 striking the detectors. Interruption of the light beams by a musician or dancer 84 will cause the tone to stop with the rapidity of interruption controlling the loudness. These arrangements on the stage can employ beams going in any direction vertically and horizontally, and both interrupting and reflecting schemes are conceivable.

If desired, in certain uses, one may eliminate the specific amplitude modulator disclosed hereinbefore and modulate the light source. For example, in a clarinet type arrangement one might modulate a solid-state light source with the desired frequency from a frequency generator and thereby eliminate the need for a separate amplitude modulator.

While I have illustrated and described certain present preferred embodiments of my invention it is to be distinctly understood that the invention is not limited thereto, but may be variously embodied within the scope of the following claims.

I claim:

1. A light beam musical instrument comprising:

at least one light source, at least one light detector positioned for receiving light from the light source and converting variations therein to electric signals, a signal sensitive amplifier which amplifies electrical signals in accordance with signal variations and is wired to receive electrical signals from the detector, said signal sensitive amplifier having means for transforming a signal received from said light detector into a transformed signal which is related to both the extent of interruption or reflection of a light beam from said light source and the rapidity of such interruption or reflection action, modulator means for receiving output signals from said signal sensitive amplifier, a frequency generator electrically connected to said modulator means, a speaker operatively associated with said modulator means, and said modulator means include an amplitude modulator for receiving output from said signal sensitive amplifier.

2. The instrument of claim 1 also comprising a second amplifier wired between the amplitude modulator and speaker.

3. The instrument of claim 1 also comprising a generally harp-shaped frame having a plurality of light sources and a light detector for each light source positioned so that light from a single light source will strike only one detector.

4. The instrument of claim 1 comprising a frame comprised of an elongated apertured body having a mouthpiece at one end and a bell at its opposite end and containing a light source and a light detector positioned near each aperture so that when the aperture is covered light from the light source will be reflected to the light detector.

5. The instrument of claim 4 also comprising a pressure transducer attached to the mouthpiece and an amplifier connected to the transducer and speaker in a manner such that pressure on the transducer will control how much the amplifier will amplify signals entering the speaker.

6. The instrument of claim 1 also comprising a stage on which the light sources and light detectors are positioned so that individuals moving across the stage will interrupt light passing from the light sources to the light detectors.

7. A light beam musical instrument comprising:

at least one light source, a plurality of light controlled signal generators each comprised of:

(i) a light detector positioned for receiving light from the light source and converting variations therein to electric signals, (ii) a signal sensitive amplifier which amplifies electrical signals in accordance with signal variations and is wired to receive electrical signals from the light detector, (iii) said signal sensitive amplifier having means for transforming a signal received from said light detector into a transformed signal which is related to both the extent of interruption or reflection of a light beam from said light source and the rapidity of the interruption or reflection action, (iv) modulator means for receiving output signals from said signal sensitive amplifier, (v) a frequency generator electrically connected to said modulator means, and (vi) said modulator means include an amplitude modulator for receiving output from said signal sensitive amplifier, at least one speaker electrically connected to the amplitude modulators.

8. The instrument of claim 7 also comprising a mixer to which all amplitude modulators are connected and which is also connected to the speaker.

9. A light beam musical instrument comprising at least one light source, at least one light detector positioned for receiving light from the light source and converting variations therein to electric signals, a signal sensitive amplifier which amplifies electrical signals in accordance with signal variations and is wired to receive electrical signals from the detector, modulator means for receiving output signals from said signal sensitive amplifier, a frequency generator electrically connected to said modulator means, a speaker operatively associated with said modulator means, said modulator means include an amplitude modulator wired to and controlled by the signal sensitive amplifier, and said signal sensitive amplifier is comprised of a. a first amplifier wired to the light detector, b. a first diode and variable resistor connected to the first amplifier so as to reverse bias the amplifier, c. a second amplifier outputting to the amplitude modulator, d. a second diode interconnecting the first amplifier to the second amplifier, e. a control transistor and capacitor wired in series to the second amplifier, and f. a third diode connecting the capacitor to the amplitude modulator.

10. A light beam musical instrument comprised of:

a frame, a keyboard having a plurality of apertures and attached to the frame, a plurality of light sources positioned so as to emit light through the apertures of the keyboard, a plurality of light detectors attached to the frame, one positioned above each aperture, a signal sensitive amplifier which amplifies electrical signals in accordance with signal variations and is wired to receive electrical signals from the detectors, said signal sensitive amplifier having means for transforming signals received from light detectors into transformed signals which are related to both the extent of interruption or reflection of the light beams from said light sources and the rapidity of such interruptions or reflection action, modulator means for receiving output signals from said signal sensitive amplifier, a frequency generator electrically connected to said modulator means, said modulator means include an amplitude modulator for receiving output from said signal sensitive amplifier, and a speaker operatively associated with the amplitude modulators.

11. The instrument of claim 10 also comprising a second amplifier wired between the amplitude modulator and speaker.

12. The instrument of claim 10 also comprising a pedal attached to the frame and connected to the second amplifier so as to control that amplifier.

13. A light beam musical instrument comprising:

at least one light source, a plurality of light controlled signal generators each comprised of:

(i) a light detector positioned for receiving light from the light source and converting variations therein to electric signals, (ii) a signal sensitive amplifier which amplifies electrical signals in accordance with signal variations and is wired to receive electrical signals from the light detector, (iii) modulator means for receiving output signals from said signal sensitive amplifier, and (iv) a frequency generator electrically connected to said modulator means, at least one speaker electrically connected to the amplitude modulators, said modulator means include an amplitude modulator wired to and controlled by the signal sensitive amplifier, and said signal sensitive amplifier includes a. a first amplifier wired to the light detector, b. a first diode and variable resistor connected to the first amplifier so as to reverse bias the amplifier, c. a second amplifier outputting to the amplitude modulator, d. a second diode interconnecting the first amplifier to the second amplifier, e. a control transistor and capacitor wired in series to the second amplifier, and f. a third diode connecting the capacitor to the amplitude modulator.

* * * * *